United States Patent [19]

Grimes

[11] Patent Number: 4,573,688

[45] Date of Patent: Mar. 4, 1986

[54] GAMEBOARD APPARATUS WITH SEPARATING DIE

[76] Inventor: John T. Grimes, 412 Brooks #D, Venice, Calif. 90291

[21] Appl. No.: 518,471

[22] Filed: Jul. 29, 1983

[51] Int. Cl.[4] ..... A63F 3/00; A63F 9/04

[52] U.S. Cl. ..... 273/241; 273/248; 273/146

[58] Field of Search ..... 273/241, 248, 258, 146; 434/211, 403

[56] References Cited

U.S. PATENT DOCUMENTS

| | | | |
|---|---|---|---|
| 60,141 | 12/1866 | Chinnock | 434/403 X |
| 836,878 | 11/1906 | Guillaume | 273/248 |
| 2,471,202 | 5/1949 | Desaulniers | 273/146 |
| 2,611,616 | 9/1952 | Kloss | 273/243 |
| 2,729,451 | 1/1956 | Larson | 273/241 X |
| 3,030,112 | 4/1962 | Scharp | 273/241 |
| 4,079,945 | 3/1978 | Brass | 273/239 |
| 4,223,892 | 9/1980 | Matherne | 273/248 |
| 4,341,386 | 7/1982 | Kleva | 273/239 |

FOREIGN PATENT DOCUMENTS

| | | | |
|---|---|---|---|
| 922147 | 11/1954 | Fed. Rep. of Germany | 273/241 |
| 2303579 | 7/1974 | Fed. Rep. of Germany | 434/211 |
| 916846 | 12/1946 | France | 273/146 |

*Primary Examiner*—Richard C. Pinkham
*Assistant Examiner*—Scott Brown
*Attorney, Agent, or Firm*—Frank L. Zugelter

[57] ABSTRACT

The invention comprises a plurality of playing fields across each of which particular plateaus or levels are mounted, in parallel relationship to one another and having on each thereof a series of stations therealong. The fields are disposed in a three-dimensional environment and the levels or plateaus in each field is traversed by a marker for each player so that upon the marker's return to a finish point in its corresponding field first, its player can be declared the winner of a game or competition played with or on the apparata. Means are provided to climb from one level or plateau to the next. A novel gamepiece or element is utilized to advance each player's marker, in turn, across the plateaus' stations and playing fields. This element itself separates at different times in its use into two members. And it also is itself a basis for self-use in a game played with it in contrast to use with a gameboard. Each member includes indicia for indicating a count so that specific advancement of a player's marker is determined. Penalty stations are provided on each playing field. The playing fields and players' markers are color coded to one another.

21 Claims, 10 Drawing Figures

GAMEBOARD APPARATUS WITH SEPARATING DIE

TECHNICAL FIELD

This invention relates to gameboard apparata, more particularly to a three-dimensional gameboard and a game piece or element for determining manner of play and movement on the gameboard.

BACKGROUND ART

The disclosure of U.S. Pat. Nos. 1,595,285; 2,053,598; 2,292,603; 2,244,762; 2,471,202; 2,729,451; 2,843,385; 2,896,950; 3,083,020; 4,129,303; and 4,184,685 show various gameboard apparata.

SUMMARY OF THE INVENTION

The invention comprises a plurality of playing fields across each of which particular plateaus or levels are mounted, in parallel relationship to one another and having on each thereof a series of stations therealong. The fields are disposed in a three-dimensional environment and the levels or plateaus in each field are traversed by a marker for each player so that upon the markers's return to a finish point in its corresponding field first, its player can be declared the winner of a game or competition played with or on the apparata. Means are provided to climb from one level or plateau to the next. A novel gamepiece or element is utilized to cause advancement of each player's marker, in turn, across the plateaus stations and playing fields. This element itself separates at different times in use into two members. Each of the two members includes indicia for indicating a count so that specific advancement of a player's marker is determined. Penalty stations are provided on each playing field. The playing fields and players' markers are color coded to one another.

An object of this invention is to provide a stimulating, entertaining and amusing game for a number of players.

Other objects of this invention are to provide a novel game board and a novel game piece for use therewith or with other gameboards, or by itself.

Another object of the invention is to provide a novel manner of play and movement on the gameboard.

A further object of this invention is to provide a game of skill, chance and competition.

These and other objects and advantages will become more apparent by a full and complete reading of the following description, appended claims thereto, and the accompanying drawing comprising two (2) sheets.

DESCRIPTION OF THE PREFERRED INVENTION

Figure 2:
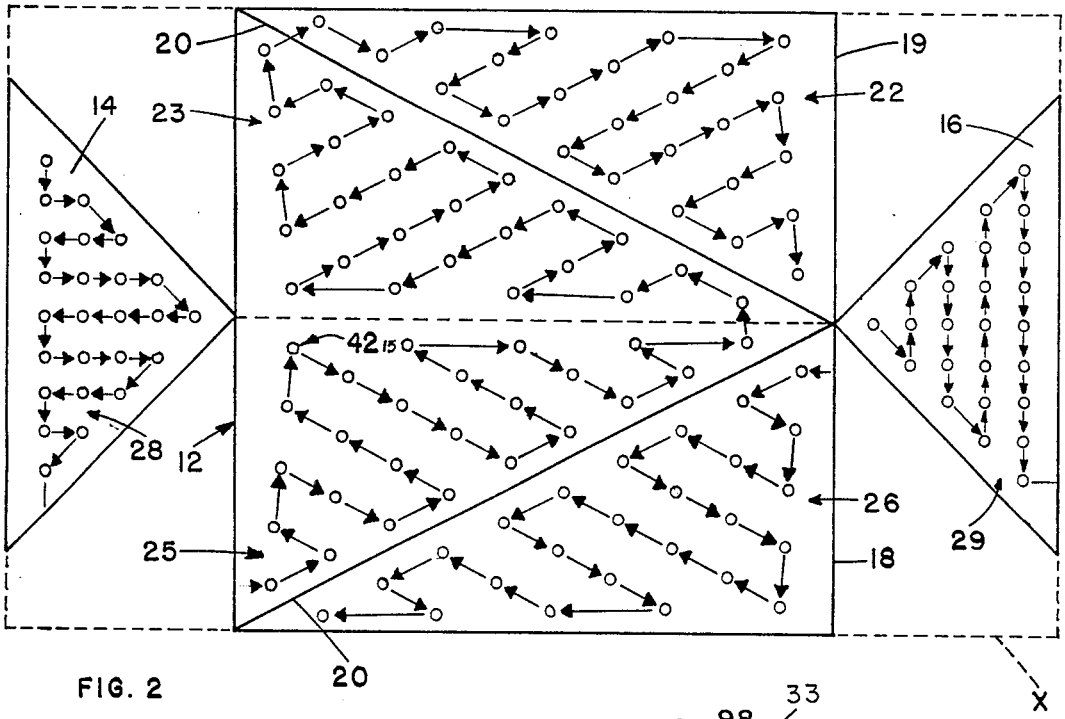
FIG. 2 is a pattern view of the panel playing surfaces constituting the gameboard of FIG. 1.
Figure 1:
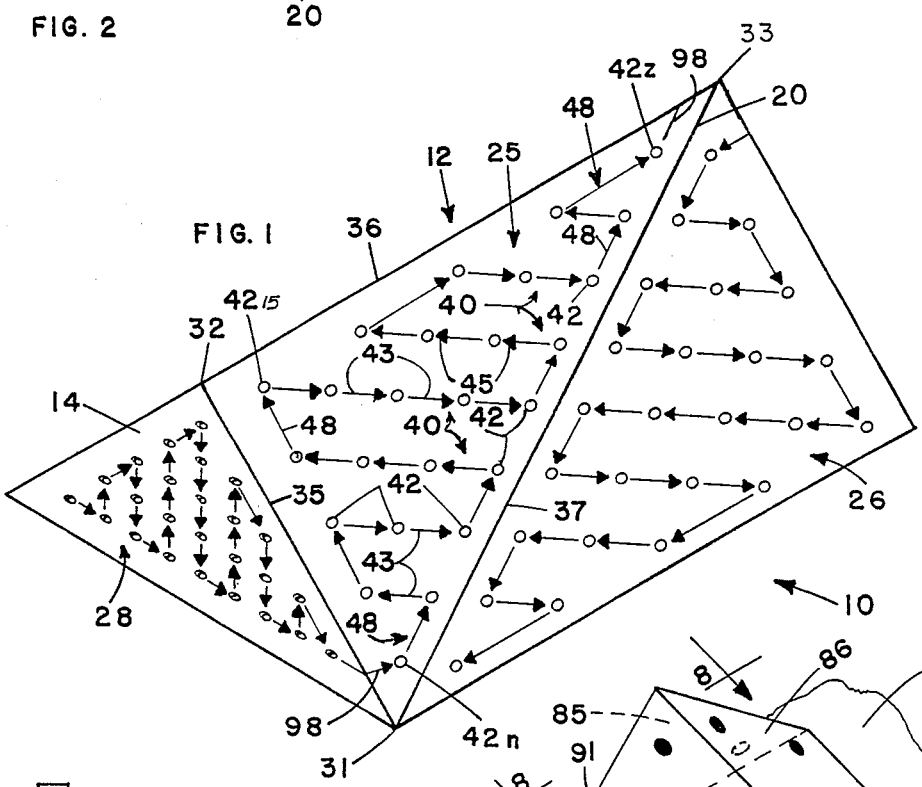
FIG. 1 is a perspective view of a three-dimensional gameboard embodying the invention.

Referring now to the drawing wherein its reference characters correspond to like numerals hereinafter, character 10 refers to one embodiment, FIGS. 1, 2 of the gameboard apparatus of the invention. Gameboard 10 in this embodiment comprises a dihedral angle member 12 at the opposite ends of which corresponding panel members 14, 16, FIG. 2, are securely mounted. The assembled three-dimensional form for gameboard 10 is seen in FIG. 1 while FIG. 2 is representative of a two dimensional material pattern shaped (partly in phantom) as a rectangle x and from which dihedral angle member 12 and panel members 14, 16 may be developed. Dihedral angle member 12 itself comprises a pair of panel members 18, 19 which respectively, in turn, are divided, by means of a mounted corresponding boundary or diagonal line 20, into triangular playing fields 22,23 and 25, 26, respectively. The end panel members 14, 16, themselves triangular in nature, constitute like playing fields 28, 29, respectively. Thus, this embodiment includes 6 playing fields 22, 23, 25, 26, 28 and 29. Each of such fields has, by a triangular definition, three (3) apeces and three (3) sides or boundaries joining together such apeces. For the purpose of clear description and maintenance of clarity in this disclosure, only one set of apeces and sides or boundaries of a single triangular playing field are referenced in FIGS. 1, 2, and it is to be understood that the following description applicable to the hereinafter described playing field 25, its apeces 31,32,33, boundaries 35, 36, 37 and its other concomitant elements is also applicable in the same way to each of the other playing fields and their concomitant elements of gameboard 10.

Figure 3:
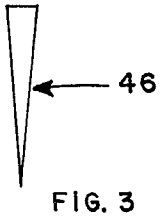
FIG. 3 is a view of a station marker which is utilized on a gameboard embodying the invention.
Figure 7:
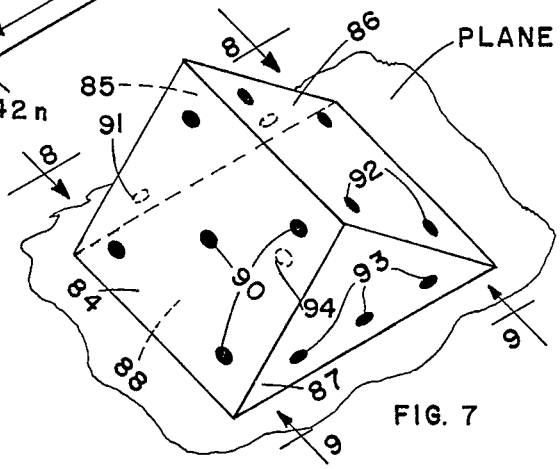
FIG. 7 is a perspective view of one of the two members shown in FIG. 6.

Playing field 25 comprises a plurality of levels or plateaus 40 mounted throughout substantially its entire triangular area, with each level 40 comprising a series of stations 42, each pair of adjacent stations 42 being operatively connected to one another by a straight line 43. The resulting plurality of straight lines 43 on each level or plateau 40 connecting its stations 42 together, are co-linear with one another. An indicium 45, such as an arrowhead, is mounted at an end of each line 43 for indicating a particular direction of movement along lines 43 across each level or plateau 40 and in which direction a player's marker 46 [FIG. 3] is to take in play of a game. Means 48 for climbing from a lower level or plateau 40 to a next adjacent level or plateau 40 are provided and comprises a line having an arrowhead 52 operatively connecting a station 42 at the end of one of the levels or plateaus 40 to a station 40 on the next adjacent ascended level or plateau 40. Climbing means 48, it will be observed, alternate in their dispositions between levels or plateaus 40, but always at one end or the other end thereof.

The levels or plateaus 40 themselves are arranged in parallel relationship with each other on playing field 25 and such parallel relationships are not parallel to any one of the sides or boundaries 35, 36, 37 of playing field 25.

In two instances on playing field 25, the levels or plateaus 40 consists of but one station, either station 42*n* or station 42*z*. Station 42*n* is a nadir station at which a player's marker 46 either begins play on the playing field (here, 25) or enters playing field 25 from a zenith station 42*z* from which a marker 46 exits from a playing field (here, 25) to either continue in play on another playing field or to enter its home playing field at its nadir station 42*n* to win a game. Each of these stations 42*n*, 42*z* is mounted on playing field 25 immediately adjacent an associated apex 31,33, respectively. It now becomes apparent that the widths of each of levels or plateaus 40 extend generally between a geometrical line passing through the remaining apex 32 and the boundary 37 opposing it, such geometrical line and boundary 37 being in general parallel relationship.

The direction of these widths of levels or plateaus 40 or of the parallel relationships of levels or plateaus 40, i.e., between apex 32 and boundary 37, provides for minimum and maximum widths for each level or plateau 40. It is observed in FIG. 1 of this embodiment that the maximum number of stations 42 in a level or plateau, five (5) here, occurs in the widest level or plateau 40 extending in the direction noted above. And the minumum width for a level or plateau 40 occurs at the nadir and zenith stations 42*n*, 42*z*, with progressively increasing and decreasing level or plateau widths between such stations 42*n*, 42*z* and the widest level or plateau 40. What has been described above in regard to playing field 25, its boundaries 35, 36, 37, its apices 31, 32, 33, the levels or plateau 40 and its stations 42, 42*n*, 42*z*, directional lines 43 (with 45), and climbing means 48, is corresponding true with respect to playing fields 22,23,26,28 and 29 together with like or correspondijng elements to those heretofore described with reference to playing field 25.

Figure 4:
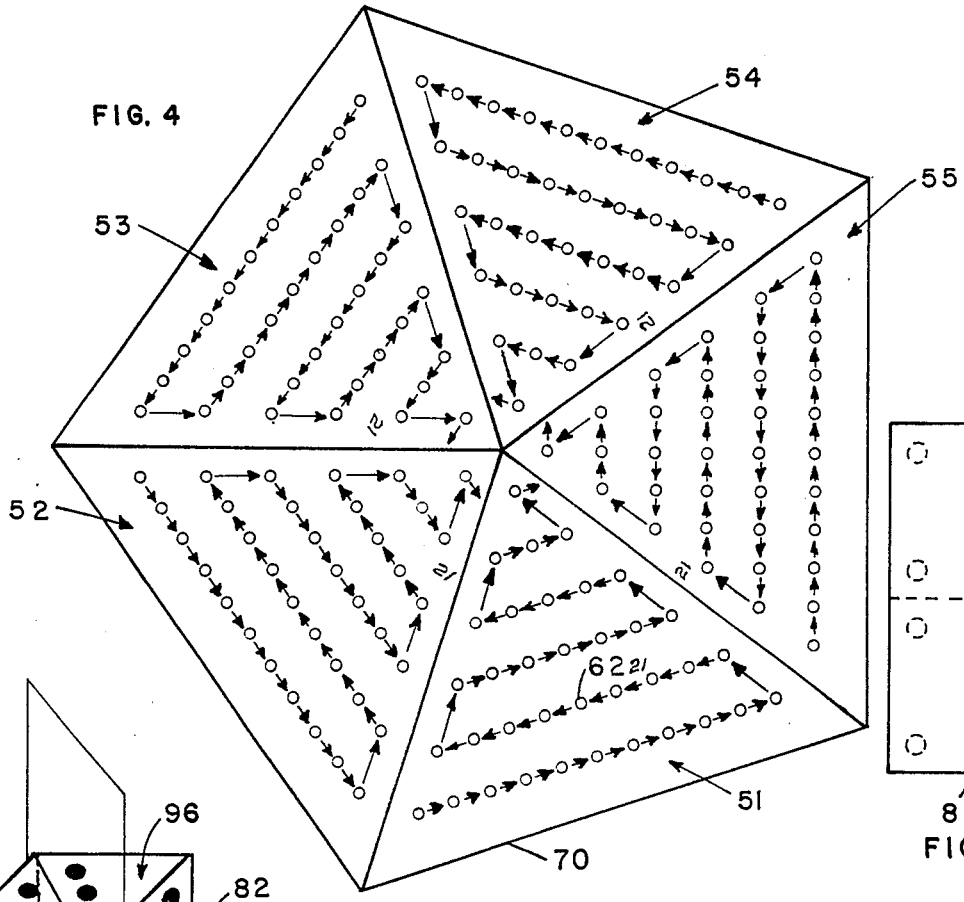
FIG. 4 is a plan view of another embodiment of the invention.
Figure 10:
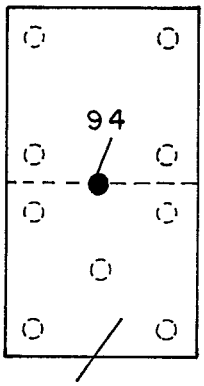
FIG. 10 is a full view of the diagonal base of either of the two members shown in FIG. 6.
Figure 5:
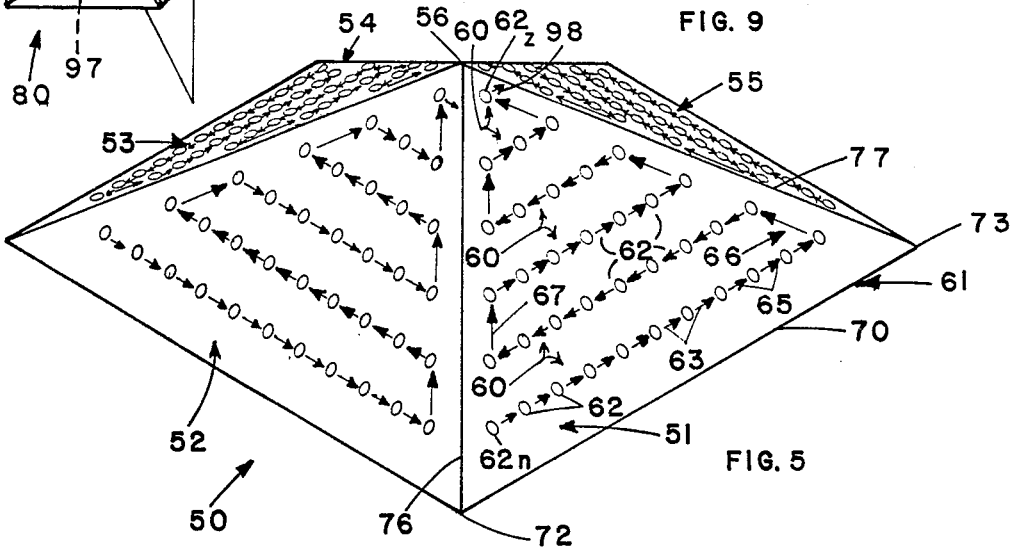
FIG. 5 is a perspective view of FIG. 4.

The apparatus 50 of FIGS. 4, 5 illustrates another three-dimensional embodiment of the invention. In this embodiment, a plurality of playing fields 51, 52, 53, 54, 55 are suitably secured together in pyramid-like fashion to form a single point or peak 56 for all fields. Each field 51, 52, 53, 54, 55 is mounted on material of suitable generally two-dimensional nature, one by which pattern for the plurality of fields can be developed in a two-dimensional scheme prior to an assembly resulting in FIGS. 4, 5. In such assembly, it is observed that each playing field is mounted in a triangular configuration which by definition includes three sides and three apices, one of which apices is the same for each playing field and which constitutes peak 56 for all fields and that of apparatus 50.

In a similar vein or description as was disclosed with reference to the embodiment of FIGS. 1, 2 the following description of playing field 51 and its concomitant elements holds true for each of the playing fields and elements, etc., in apparatus 50.

Playing field 50 comprises a plurality of levels or plateaus 60 mounted on and throughout substantially an entire triangular area 61, with each plateau 60 comprising a series of stations 62, each pair of adjacent stations 62 being operatively connected to one another by a straight line 63. The resulting plurality of straight lines 63 on each plateau 60, connecting its stations 62 together, are co-linear with one another. An indicium 65, such as an arrowhead, is mounted at an end of each line 63 for indicating a particular direction of movement along lines 63 across each plateau 60 and in which direction marker 46 [FIG. 3] is to take in play of a game. Means 66 for climbing from one plateau 60 to a next adjacent plateau 60 are provided and each preferably comprises an arrowheaded line 67 operatively connecting a station 62 at the end of one of the plateaus 60 to a station 62 on the next adjacent ascending plateau 60. The disposition of each means 66 in an ascending mode on playing field 51, it will be seen, is in the alternative at opposite ends of the levels or plateaus 60, similar to the dispositions of means 48 of the embodiment of FIG. 1.

The plateaus 60 themselves are arranged in parallel relationship with each other on playing field 51. In this embodiment, such parallel relationship is generally disposed parallel to a lower most boundary 70 for playing field 51, i.e., the base side of the triangular configuration encompassing playing field 51.

In one instance on playing field 51, a plateau 60 consists of but one station 62*z*, FIG. 5, a zenith station at which a player's marker 46 exits from playing field 51 to enter the next playing field's nadir station 62*n*, FIG. 5, as the finish point for that particular player's marker 46, or continue, in game play, through nadir station 62*n*. Station 62*n* is, of course, a starting station for its corresponding playing field.

It is to be noted that the widest plateau 60 is disposed immediately adjacent boundary 70, extending between apices 72, 73 of the triangular configuration for playing field 51, which constitutes a portion of the entire base for apparatus 50, such base of course being composed for all such like base boundaries for each of the playing fields.

The directions of the lineal widths of plateaus 60 extend toward the lateral and inclined boundaries 76,77 forming the other two sides of the triangular configuration for playing field 51, and which extend to and form its apex or peak 56. Thus, the widths of plateaus 60 as they ascend in order towards the plateau 60 having but station 62*z* thereon decreases.

What has been described above in regard to playing field 51, its boundaries 70, 76, 77, its apices 72, 73, 56, plateaus 60 and their stations 62, 62*n*, 62*z*, directional lines 63 (with 65), and climbing means 66, is correspondingly true with respect to playing fields 52, 53, 54 and 55 together with like or corresponding elements heretofore described with reference to playing field 51.

FIGS. 6–10 illustrate a novel element of the invention. Element 80 comprises a pair of individual members 81, 82 which when properly assembled to each other form a rectangular parallepiped, preferably a cube. The members 81,82 are symetrical. Each comprises a triangular configuration formed of solid material, and includes, FIG. 7, 4 sides, 84, 85, 86, 87 and a diagonal base 88, all of which are joined together. On each side 84, 85, 86, 87 of each member 81, 82, an indicium 90, 91, 92 and 93, respectively, is mounted, as well as a particular indicium 94 being mounted on its corresponding diagonal base 88. Preferably, these indicia take the form of one or more dots.

Figure 6:
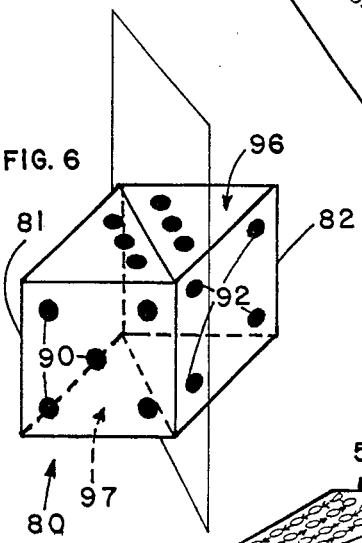
FIG. 6 is a perspective view of a novel element for use by itself or with the gameboard apparata of FIGS. 1, 2, 4, 5, a geometrical plane being shown passing through the diagonal of the element and along which the element separates into two distinct and symetrical members.
Figure 8:
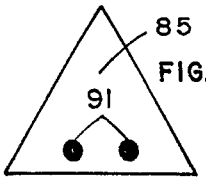
FIGS. 8 and 9 are full views of opposing sides of the member shown in FIG. 7 and as seen along the direction of arrows 8—8 and 9—9, respectively.
Figure 9:
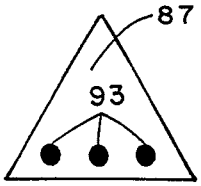

When assembled together, for example, when ready for use in play of a game, the game piece will appear as the unit shown in FIG. 6. In this instance then, sides 96 and 97 of cube 80 take the place of or is substituted for side 87 and side 85, respectively.

It is essential to the utilization of cube 80 that it includes the physical characteristics or qualities of resilience and adherence. Its resiliency quality provides for the springiness or reboundingness of cube 80 as a cube and as in the cube's mode of separate members 81, 82. Its adhering quality provides for the cleavage or holding together of members 81, 82 as they are thrown, in game play, as a unit. Such unit, on the other hand, can also come apart by manully separating it into its members 81, 82 so that each of such members can tumble around or about under the force of its own motion, to land on one of its sides or its diagonal base.

It is to be recognized that the resilient characteristic of the solid material forming element 80, or its members 81, 82 applies to element 80 as a single or composite unit, and to members 81, 82, singly or forming together such unit, and that the manner of throw of the unit itself under normal or usual manual forces does not separate the unit into its two elements 81,82, because of the adhering quality of its substance.

As an example of the nature of the substance forming element 80 or its members 81, 82, an artist's eraser compound with a polyurethane base provides a solid material which includes these characteristics of resiliency and adherency. The resiliency quality prevents loss of shape for element 80, to be found in the polyurethane base, while the adherency quality is found in the nature of the erasing compound.

Each player's marker 46 is formed in a tapering or conical manner out of suitable material, such as plastic, wood, metal, while all stations in each embodiment are formed as circular holes in their corresponding playing fields to complement the fitting of marker 46. Color coding between each player's marker and its corresponding home playing field provides a quick and convenient reference for the players as a game played on either embodiment begins, progresses, and ends.

In play of a game on either embodiment, anyone of the stations may constitute a penalty station back to which a player's marker 46 is moved. For example, were a game to include the condition that a player's full roll of cube 80 must provide advancement to the last plateau and particularly to its zenith station [station 42*z* and 62*z*] in a playing field prior to further advancement without being penalized, and such full roll if taken would over-advance the player's marker 46, such marker could retreat to a station, say, station $\mathbf{42}_{15}$, FIG. 2, or $\mathbf{62}_{21}$, FIG. 4 and begin from there in the next turn. Other conditions could impose other penalties, even back to a starting station 42*n*, 62*n* on the nadir level or plateau for a given playing field.

When used in gameplay with either board 10 or 50, game piece 80 is preferably thrown manually, such as in or from the palm of the hand, a player holding matching members 81, 82 arranged as seen in FIG. 6, so that they together form substantially a cube or the like. A full roll of the cube 80 involves three throws thereof. The piece 80 is first thrown, somewhat in a light vein, against an interior corner of a box-like structure, coming to rest on a table, floor or surface part of or adjacent to such box-like structure. In this mode of throwing, cube 80 remains together by reason of its adhering qualities. The cube 80 lands on one of its six sides 84, 86, 96 or 97, with a side opposing the landed side being visible to the players and from which one of the counting indicia of 4-dots, 5-dots or 6-dots becomes known. Thereafter, cube 80 is manually separated into its two members 81, 82. Each member, by itself, then is thrown. Consequently, each member will come to rest either on one of its sides 84, 85, 86, 87 or on its diagonal base 88. Landing on a side provides a specific counting indicium on its opposing side which is visible to the player's eyes. However, landing on diagonal base 88 exposes two counting indicia, the 5-dots and the 4-dots, on two sides 84, 86 of the particular member 81 or 82.

The results of these three throws of or full roll for cube 80 is utilized in play of a game. For example, ony one indicium [a 4-dots, 5-dots or 6-dots] may be counted in the first throw of cube 80, as it remains together. Say it is the five dots. In the subsequent two throws of members 81, 82, one of two results occurs as each member comes to rest. Either, a member 81, 82 lands on its corresponding diagonal base 88 or lands on one of its four sides. The indicia is counted and added to the 5-dots indicium.

Thus, through these alternative throws for cube 80 and its members 81, 82, rules can be developed to determine an actual count for use in a game either with this gamepiece itself or with one of the apparata 10, 50. For example, if member 81 lands on its diagonal base 88 and member 82 lands on one of its sides, the player may choose to use either the indicium 4-dot or indicium 5-dot exposed on member 81, to be added to his count obtained from member 82 and to the count obtained from the first throw of cube 80 when it stayed together. If both members 81, 82 land on their corresponding diagonal bases 88, then a total count of 9 only [4 dots plus 5 dots] must be taken, to be added to the count obtained on the first throw when cube 80 remained as a single unit.

In assembling members 81, 82 together to form cube 80, the same indicium on one side, i.e., the three (3) dots on side 87 of member 81 is matched with the same three (3) dots [indicium] on side 87 of member 82. Or, a like matching for the 2-dot indicia could be under-taken. Otherwise, the indicium of five (5) dots would be shown four times on cube 80 and the indicium of four (4) dots would be shown twice. The correct indicia showing on a cube 80 are six (6) dots once, five (5) dots on two sides and four (4) dots on three sides.

Two convenient ways of employing apparata 10, 50 and cube 80 now will be described.

First, cube 80 can be utilized by itself, in a somewhat similar way to the game of "craps". The first throw of cube 80, as a cube, decides what number is to be rolled to win, in subsequent rolls. Subsequent successive throws are made, with members 81, 82 separated from one another, i.e., one at a time.

The object of this game, say, is to roll a number first before a nine is rolled. The first thrown number has to be a four (4), five (5), or six (6).

When one member, 81 say, lands on its diagonal base 88, the throw is in favor of the player whose turn it is. The player can choose either the four (4) or the five (5) which is face up and optionally add that to the score from member 82 which is subsequently thrown. When the throws of both members 81, 82, in singly fashion, result in both members landing on their corresponding diagonal bases 88, then the player loses; a four (4) from one member and a five (5) from the other member adds to the losing score of nine (9).

In the second manner of play, wherein gamepiece 80 in used in association with movement of marker 46 on either of gameboards 10, 50, each player's colored marker 46 is inserted in his correspondingly colored playing field's starting station 42*n*, 62*n*. The first player throws cube 80 as a cube. Then he throws each member 81, 82 separately. The score is calculated by adding the indicia turned up in the roll comprising the three throws. Such score determines the number of stations the player's marker 46 moves over, along the levels or plateaus 40, 60, in the direction of arrowheaded lines 43, 63 on the particular playing field (such as field 26 or field 51). One by one the players take their respective turns, their markers 46 continuing to advance across the levels of plateaus 40, 60, climbing from one to the next via climbing means 48, 66 to the corresponding zenith station 42*z*, 62*z* after which the marker moves to the nadir or starting station 42*n*, 62*n* on the next playing field. And so forth, until the marker reaches its home field starting station first, thereby ending the game. As noted above, penalties may be imposed if a marker does not land in a zenith station prior to advancing to the next field on the gameboard 10, 50.

Various changes and modifications are available in the use of apparata 10, 50. For example, directional arrow 98, FIGS. 1, 5, may be utilized at zenith stations 42*z*, 62*z* to guide a marker 46 from one playing field to the starting station 42*n*, 62*n* in the playing field next to be navigated. In use of gamepiece 80, the two separate members 81, 82 may be held separately when thrown from the hand, in one throw, as distinguished from throwing each one from the hand in two throws. In other words, only two throws rather than three can be used to complete a full roll.

Gameboard material known in the art is suitable for making gameboards 10, 50 and its concomitant elements heretofore described. The apparatus is readily fabricated therefrom, in known art processes. Cube 80 is formed by conventional processes, utilizing the described eraser compound and polyureathane-base material. The manufacture of marker 46 is well known in the arts.

Pursuant to the patent statutes, the principle of this invention has been explained and exemplified in a manner so that it can be readily practiced by those skilled in the art to which it pertains, such exemplification including what is presently considered to represent the best embodiment of the invention.

Therefore, what I claim as patentably distinct and novel is:

1. A game apparatus comprising a gameboard having a plurality of playing fields each bounded within a triangular configuration having apices and sides, a plurality of plateaus mounted in each of said playing fields, a series of stations spaced from one another on each of said plateaus, means operatively connecting together said spaced stations and for indicating direction of movement for a marker applied during play to said stations mounted between said stations, means for climbing from one of said plateaus to the next adjacent plateau mounted at corresponding ends for said one of said plateaus and next adjacent plateau, said series of stations including nadir and zenith stations in their own respective plateaus for corresponding entry and exit of play on the corresponding playing field, they being mounted immediately adjacent their associated and corresponding apices, at least one plateau having a maximum width and two plateaus having minimum widths in said plurality of plateaus, the plateaus having minimum widths occurring at said nadir and zenith stations, and means for directing a marker to a next playing field mounted across the sides of two adjacent playing fields and extending from the zenith station on each playing field, to thereby provide for play on all playing fields by the same marker.

2. The game apparatus of claim 1 wherein said climbing means mounted at said corresponding ends is mounted in an alternate ascending mode at such ends on each of said playing fields.

3. The game apparatus of claim 2 wherein said plurality of plateaus are parallel but not parallel to any one of such sides.

4. The game apparatus of claim 3 wherein the number of plateaus to each side of a plateau having the maximum width is equal in number.

5. The game apparatus of claim 1 wherein the plateaus between one having a maximum width and one having a minimum width arithmetically decrease from such one having a maximum width.

6. The apparatus of claim 5 wherein the number of plateaus mounted to each side of a plateau having the maximum width is equal in number.

7. The game apparatus of claim 1 wherein said operatively connecting and indicating means comprises lines with directing indicia thereon.

8. The apparatus of claim 7 wherein the number of plateaus to each side of a plateau having the maximum width is equal in number.

9. The game apparatus of claim 1 wherein said plurality of plateaus are parallel but not being parallel to any one of such sides and the number of plateaus to each side of a plateau having the maximum width is equal in number.

10. The game apparatus of claim 9 wherein said climbing means mounted at said corresponding ends is mounted in an alternate ascending mode at such ends on each of said playing fields.

11. The game apparatus of claim 10 wherein said operatively connecting and indicating means comprises lines with directing indicia thereon.

12. The apparatus of claim 9 wherein such plateaus between one having a maximum width and one having a minimum width arithmetically decrease from the one having a maximum width.

13. The game apparatus of claim 12 wherein said operatively connecting and indicating means comprises lines with directing indicia thereon.

14. The apparatus of claim 1 having at least one of said stations in a series thereof functioning as a penalty station.

15. The game apparatus of claim 1 wherein said nadir and zenith stations constitute the two plateaus having minimum widths.

16. The game apparatus of claim 1 wherein said plurality of plateaus are parallel but not parallel to any one of such sides.

17. The game apparatus of claim 1 wherein the number of plateaus to each side of a plateau having the maximum width is equal in number.

18. The game apparatus of claim 1 including a gamepiece comprising a pair of cooperating and identical but completely separate members, each member being in the form of one-half of a rectangular parallelpiped, solid throughout, having a diagonal base, the bases of the respective members being mated so as to form a cube having six sides, indicia mounted on said diagonal base and on each of the other four sides forming such one half, the solidity of each member comprising an art eraser compound substance or the like and a polyurethane base, thereby providing the qualities of resiliency and adherency, whereby the cube is not separated into its members when thrown in play with said apparatus and retains a springiness from the force with which it strikes a surface.

19. A game apparatus comprising:

a gameboard having a plurality of playing fields each bounded within a triangular configuration having apices and sides, a plurality of plateaus mounted in each of said playing fields and including plateaus of maximum and minimum widths the plateaus between those of maximum and minimum widths arithmetically decreasing, a series of stations each spaced from one another on each of said plateaus, means operatively connecting together said stations and for indicating direction of movement for a marker applied during play to said stations mounted between said stations, said operatively connecting and indicating means comprising lines with directing indicia thereon, means for climbing from one of said plateaus to the next adjacent plateau mounted at corresponding ends for said one of said plateaus and next adjacent plateau, said climbing means mounted at said corresponding ends being mounted in an alternate ascending mode at such ends on each of said playing fields, nadir and zenith stations in their own respective plateaus for corresponding entry and exit of play on the corresponding playing field, they being mounted immediately adjacent their associated and corresponding apices, said plurality of plateaus being parallel to one of said sides with the plateaus closest to said one of said sides having a maximum width and including said nadir station, means for directing a marker to a next playing field mounted across the sides of two adjacent playing fields and extending from the zenith station on one of said adjacent playing fields to thereby provide for play on all playing fields by each marker, and a gamepiece comprising (a) a pair of cooperating and indentical but completely separate members, each of said members being in the form of one-half of a rectangular parallelpiped, solid throughout, having a diagonal base, the bases of the respective members being mated so as to form a cube having six sides, (b) indicia mounted on said diagonal base and on each of the other four sides forming such one-half, the solidity of each member comprising an art eraser compound substance or the like and a polyurethane base, thereby providing the qualities of resiliency and adherency, whereby the cube is not separated into its members when thrown in play with said apparatus and retains a springiness from the force with which it strikes a surface.

20. The apparatus of claim 19 having at least one of said stations in a series thereof functioning as a penalty station.

21. A gamepiece comprising a pair of cooperating and identical but completely separate members, each member being in the form of one-half of a rectangular parallelpiped, solid throughout, having a diagonal base, the bases of the respective members being mated so as to form a cube having six sides, indicia mounted on said diagonal base and on each of the other four sides forming such one half, the solidity of each member comprising an art eraser compound substance and a polyurethane base, thereby providing the qualities of resiliency and adherency, whereby the cube is not separated into its members when thrown and retains a springiness from the force with which it strikes a surface.

* * * * *

UNITED STATES PATENT AND TRADEMARK OFFICE

CERTIFICATE OF CORRECTION

PATENT NO. : 4,573,688

DATED : March 4, 1986

INVENTOR(S) : Grimes, John T.

It is certified that error appears in the above-identified patent and that said Letters Patent is hereby corrected as shown below:

In column 8, line 40, "the" is to be read as -- such --.

Signed and Sealed this

Twentieth Day of October, 1987

*Attest:*

*Attesting Officer*

DONALD J. QUIGG

*Commissioner of Patents and Trademarks*